US008302955B2

(12) United States Patent
Shmaiser et al.

(10) Patent No.: US 8,302,955 B2
(45) Date of Patent: Nov. 6, 2012

(54) ROTATING VACUUM FINGERS FOR REMOVAL OF PRINTING MEDIA FROM AN IMPRESSION DRUM

(75) Inventors: Aron Shmaiser, Rishon Iezion (IL); Ayal Galili, Beit Elazari (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1952 days.

(21) Appl. No.: 11/155,933

(22) Filed: Jun. 17, 2005

(65) Prior Publication Data

US 2007/0001391 A1 Jan. 4, 2007

(51) Int. Cl.
*B65H 3/12* (2006.01)

(52) U.S. Cl. ..... 271/95; 271/276

(58) Field of Classification Search ..... 271/276, 271/194, 196, 95

See application file for complete search history.

(56) References Cited

U.S. PATENT DOCUMENTS

| | | | | | |
|---|---|---|---|---|---|
| 2,395,497 | A * | 2/1946 | Nordquist | 271/95 |
| 2,568,069 | A * | 9/1951 | Herr | 271/11 |
| 2,714,006 | A * | 7/1955 | Layden | 271/95 |
| 2,936,681 | A * | 5/1960 | Earp | 493/310 |
| 3,026,989 | A * | 3/1962 | Schaltegger | 198/471.1 |
| 3,385,595 | A * | 5/1968 | Benatar et al. | 271/95 |
| 3,386,558 | A * | 6/1968 | Benatar | 198/408 |
| 3,575,409 | A * | 4/1971 | Calvert | 271/95 |
| 3,599,541 | A * | 8/1971 | Allen | 493/310 |
| 3,663,012 | A * | 5/1972 | Van Den Honert | 271/276 |
| 3,992,993 | A * | 11/1976 | Kuhn et al. | 101/409 |
| 4,018,161 | A * | 4/1977 | Johne et al. | 101/231 |
| 4,024,814 | A * | 5/1977 | Becker | 101/410 |
| 4,127,265 | A * | 11/1978 | Wirz et al. | 271/260 |
| 4,241,659 | A * | 12/1980 | Fischer | 101/231 |
| 4,343,241 | A * | 8/1982 | Rudolph et al. | 101/231 |
| 4,378,734 | A * | 4/1983 | Wirz | 101/230 |
| 4,667,531 | A * | 5/1987 | Kato et al. | 74/567 |
| 4,790,244 | A * | 12/1988 | Otfried et al. | 101/231 |
| 5,028,044 | A * | 7/1991 | Fischer | 271/91 |
| 5,029,524 | A * | 7/1991 | Wirz et al. | 101/232 |
| 5,054,761 | A * | 10/1991 | Dietrich et al. | 271/95 |
| 5,142,983 | A * | 9/1992 | Kobler et al. | 101/409 |
| 5,308,056 | A * | 5/1994 | Achelpohl | 271/183 |
| 5,426,920 | A * | 6/1995 | Quadalti | 53/564 |
| 5,431,384 | A | 7/1995 | Obermiller | |
| 5,480,138 | A * | 1/1996 | Haupenthal et al. | 271/276 |
| 5,511,722 | A | 4/1996 | Dixon | |
| 5,645,680 | A * | 7/1997 | Rietheimer | 156/567 |
| 5,653,671 | A * | 8/1997 | Reuteler | 493/313 |
| 5,997,458 | A | 12/1999 | Guttinger | |
| 6,048,120 | A | 4/2000 | Kerr | |
| 6,120,143 | A | 9/2000 | Narushima | |
| 6,313,859 | B1 | 11/2001 | Kerr | |
| 6,385,431 | B1 * | 5/2002 | Arcaro et al. | 399/381 |
| 6,438,352 | B1 * | 8/2002 | Landa et al. | 399/401 |
| 6,488,274 | B1 * | 12/2002 | Hansch | 271/10.01 |
| 6,578,846 | B2 * | 6/2003 | Maul et al. | 271/277 |
| 6,639,622 | B2 | 10/2003 | Kerr | |
| 6,698,749 | B2 * | 3/2004 | Muller | 271/99 |
| 6,851,672 | B1 * | 2/2005 | Shmaiser et al. | 271/276 |
| 6,912,952 | B1 * | 7/2005 | Landa et al. | 101/230 |
| 7,273,343 | B2 * | 9/2007 | Ziegler | 414/732 |
| 7,306,222 | B2 * | 12/2007 | Kaya et al. | 271/276 |
| 2004/0245697 | A1 * | 12/2004 | Kaya et al. | 271/10.11 |

* cited by examiner

*Primary Examiner* — Michael McCullough

(57) ABSTRACT

A printing and peeling arrangement comprises an impression drum for supporting a print medium during application of a printing image thereto, and one or more rotating vacuum fingers for applying vacuum via suction caps to the print medium to peel the print medium from the impression drum after printing. The vacuum finger is mounted for radial motion towards the impression drum and thereby avoids impact damage onto the print medium from the edges of the suction caps that results from a purely rotational approach to the drum.

22 Claims, 5 Drawing Sheets

ROTATING VACUUM FINGERS FOR REMOVAL OF PRINTING MEDIA FROM AN IMPRESSION DRUM

FIELD AND BACKGROUND OF THE INVENTION

The present invention relates to rotating vacuum fingers for removal or peeling off of print media, typically paper, from an impression drum, and, more particularly, but not exclusively to the removal of print media from a drum that prints multiple colors in multiple rotations or separations.

Vacuum fingers are hollow tubes that carry a vacuum, and have suckers at one end to transfer the suction to paper or any other print medium that it is desired to move, feed or remove within a printing, photocopying or any other environment in which paper feeding is necessary. The present disclosure relates specifically to rotary mounted vacuum fingers that are intended to counter-rotate in association with an impression drum, and remove the paper or other print medium from the impression drum following the application of the printing impression to the paper. In such a case the paper wraps onto the drum to receive the impression and then meets the vacuum finger which peels the paper from the drum.

Patents relating to rotary systems that utilize suckers to assist with feeding of paper in association with a drum include U.S. Pat. Nos. 5,431,384, 6,313,859, 6,639,622, 6,048,120, GB 735,477 and U.S. Pat. No. 6,120,143.

In a typical drum the paper rotates about the drum once, receives an impression with a single color ink and is then peeled away. However, in a recent development, multi-color print drums have become available in which several colors are applied to the paper in a spread of several rotations or separations, one color being applied per separation. Such a development has been enabled by inks that can easily be cleaned. In such a case, the paper meets the suction fingers at each separation, but suction is only applied at the end of the spread. In some cases up to seven colors may be applied in a spread, requiring seven separations. Suction is only applied following the last rotation.

Reference is now made to FIG. 1 which shows part of a printed sheet and illustrates zones 10 of colored printing. The zones comprise a non-printed region 12, and a printed region 14. Within the printed region 14 are a series of marks 16 which spoil the finish of the printed image.

The present inventors attempted to determine how the marks were formed. In doing so they studied the operation of the peeling process for removing paper from the impression drum. The peeling process is illustrated in FIG. 2 which is a simplified schematic diagram showing a cross section of an impression drum with paper and associated paper peeling apparatus. In FIG. 2, an impression drum 20 is fed with paper 22 on which an impression is applied. The paper 22 is then peeled from the impression drum by the paper peeling apparatus. In the paper peeling apparatus, a vacuum is applied to the paper 22 by a suction cap 24. The suction cap 24 is fed with the vacuum via a vacuum finger 26 which is a hollow tube connected to a central vacuum source.

In use the drum 20 rotates and the paper rotates on the drum. A plurality of vacuum fingers 26 rotate, in the opposite sense to drum 20, about drive shaft 28, such that the vacuum fingers touch the edge of the drum tangentially at one point in their rotation, the point at which the paper is to be peeled from the drum. At the point of peeling, the rotational velocities at the center of the suction cap and of the paper are matched so as to minimize any impact damage of the suction cap on the paper and allow the vacuum fingers to peel the paper smoothly from the drum.

The present inventors studied the above mechanism for possible causes of the impact damage and it was noted that the suction caps have a finite radius and that the rotational velocities between the suction cap and the paper are only matched for a certain point on that radius. That is to say the velocity can be matched for the center of the suction cap in which case there is a speed mismatch with the brim 30 of the cap, or the speed can be matched with the brim 30, in which case there is a mismatch with the center. Either way there is a possible cause for impact damage. Furthermore the brim 30 of the suction cap extends outwardly beyond the circumference described by the locus of travel of the center of the suction cap, meaning that the brim presumably impacts and attempts to dig in to the paper at its point of initial contact.

The impacts are presumably made worse in the case of multi-color printing in a spread over multiple separations. As explained above, the vacuum is switched off when additional rotations of the paper are required for remaining colors, however the fingers continue to rotate and impacts still occur even during rotations when the paper is not peeled from the drum, simply making the impact damage more noticeable.

A number of prior art patents describe uses of suckers in ways that do not impact the medium being fed, but none of these are suitable for paper pick up from a rotary drum. U.S. Pat. No. 5,997,458 describes a rotary object feeder in which suckers are used to transfer cardboard objects. The suckers are mounted on a planetary device and thus are not suitable for paper feed from a drum. In the same context U.S. Pat. No. 5,511,722 teaches an offset rotary mechanism for transferring cartons from a stack to a belt. Again the system is not intended for paper feeding from a rotating drum.

Finally U.S. Pat. No. 5,431,384 teaches a pickup and transfer roller in which the entire roller is lifted during part of the transfer cycle.

The present inventors recognized a need for a paper peeling system for removing paper from a drum, which is devoid of the above limitations.

SUMMARY OF THE INVENTION

According to one aspect of the present invention there is provided a printing and peeling arrangement comprising:

an impression drum for supporting a print medium for receipt of a printing image, and at least one rotating vacuum finger for applying vacuum to the print medium to remove the print medium from the impression drum after receipt of the printing image, wherein the vacuum finger is mounted for a radial component of motion towards the impression drum.

In an embodiment, the vacuum finger is mounted on a rotating shaft via a cam, and wherein the cam is configured to apply the radial component of motion towards the impression drum.

The cam may be configured via a lobe orientated towards the drum.

The vacuum finger may have a radius of rotation which is insufficient to reach the drum but which is sufficient to reach the drum when riding on the lobe.

The cam may be disconnectable, thereby to provide an idling motion in which the radial motion is not transferred to the vacuum finger.

The vacuum finger may comprise a suction head for applying the vacuum to the print medium, the suction head having an outer radius greater than an outer radius of the vacuum finger, and the radial motion is sufficient to prevent an impact of the outer radius of the suction head with the print medium.

A rate of rotation of the vacuum finger may be such as to equalize a velocity of the suction head with the print medium at a point of touch.

In an embodiment, the impression drum has a rotation in a first sense when printing and the vacuum finger is configured to rotate in the opposite sense, thereby to achieve the equalized velocity.

The vacuum finger may be connected via a flexible vacuum tube to a vacuum source.

The printer is typically a multi-color printing arrangement able to apply impressions in a spread involving different colors at successive separations.

According to a second aspect of the present invention there is provided a peeling apparatus for peeling a print medium from an impression drum after application of an impression to the print medium, the apparatus comprising a vacuum finger and mounting therefor, the mounting comprising a shaft and a cam, the vacuum finger being mounted radially about the shaft thereby to rotate about the shaft and further being mounted on the cam, the cam being configured with a lobe to add a radial motion component to the vacuum finger upon the rotation, the lobe being aligned such that the radial motion component describes a linear approach to the impression drum.

The cam may be disconnectable, thereby to provide an idling motion in which the radial motion component is not transferred to the vacuum finger.

In an embodiment, the vacuum finger comprises a suction head for applying a vacuum to the print medium, the suction head having an outer radius greater than an outer radius of the vacuum finger, and the radial motion is sufficient to prevent an impact of the outer radius of the suction head with the print medium.

In an embodiment, a rate of rotation of the vacuum finger is such as to equalize a velocity of the suction head with the print medium at a point of touch.

Preferably, the impression drum has a rotation in a first sense when printing and the vacuum finger is configured to rotate in the opposite sense, thereby to achieve the equalized velocity.

The vacuum finger may be connected via a flexible vacuum tube to a vacuum source.

The apparatus may be part of a multi-color printing system able to apply impressions in different colors at successive rotations.

According to a third aspect of the present invention there is provided a method for peeling a print medium from a rotating drum, the drum rotating in a first sense, the method using a plurality of vacuum fingers having suction caps mounted in proximity to the rotating drum and being able to apply vacuum via the vacuum fingers to the suction caps, the method comprising:

rotating the vacuum fingers with a rotary motion in a second opposite sense, and applying a linear component to the rotary motion such as to cause the vacuum fingers to extend linearly outwards upon approaching the drum to contact the print medium and retract linearly upon receding from the drum.

The method may comprise disconnecting the linear component to provide an idling motion in which the print medium is not contacted.

The method may comprise:

disconnecting the linear component to provide an idling motion of the vacuum fingers in which the print medium is not contacted, carrying out a predetermined number of rotations of the drum, reconnecting the linear component for a further rotation of the drum, and peeling the paper from the drum at the final rotation.

The method may comprise applying an impression using a different color ink for each rotation.

According to a fourth aspect of the present invention there is provided a method for peeling a print medium from a rotating drum, the drum rotating in a first sense, the method comprising:

mounting a plurality of vacuum fingers having suction caps in proximity to the rotating drum, applying vacuum via the vacuum fingers to the suction caps, rotating the vacuum fingers with a rotary motion in a second opposite sense, and applying a linear component to the rotary motion such as to cause the vacuum fingers to extend linearly outwards upon approaching the drum to contact the print medium and retract linearly upon receding from the drum.

Unless otherwise defined, all technical and scientific terms used herein have the same meaning as commonly understood by one of ordinary skill in the art to which this invention belongs. The materials, methods, and examples provided herein are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
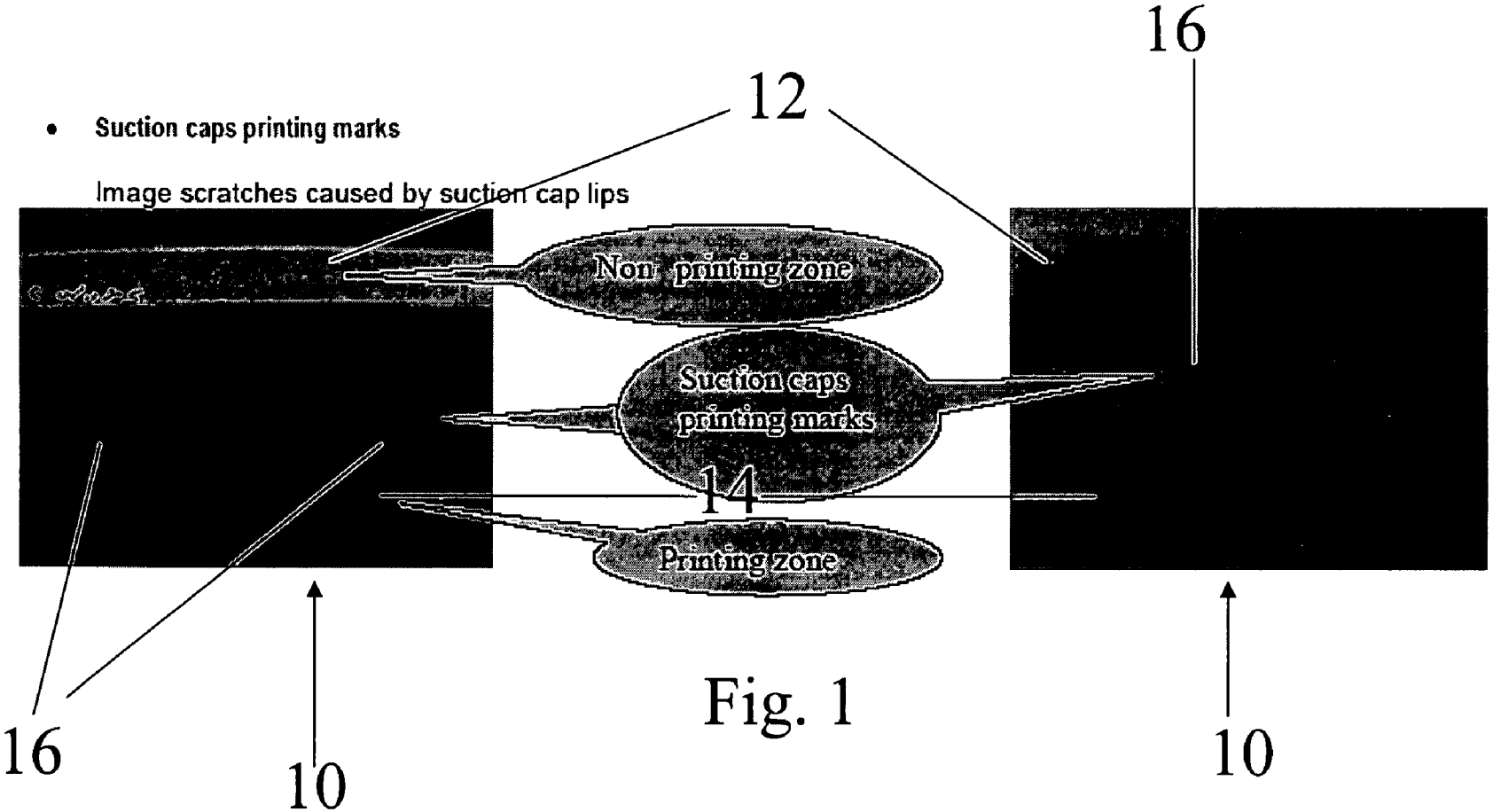
FIG. 1 is a simplified diagram showing impact damage on printed surfaces from suction caps.
Figure 2:
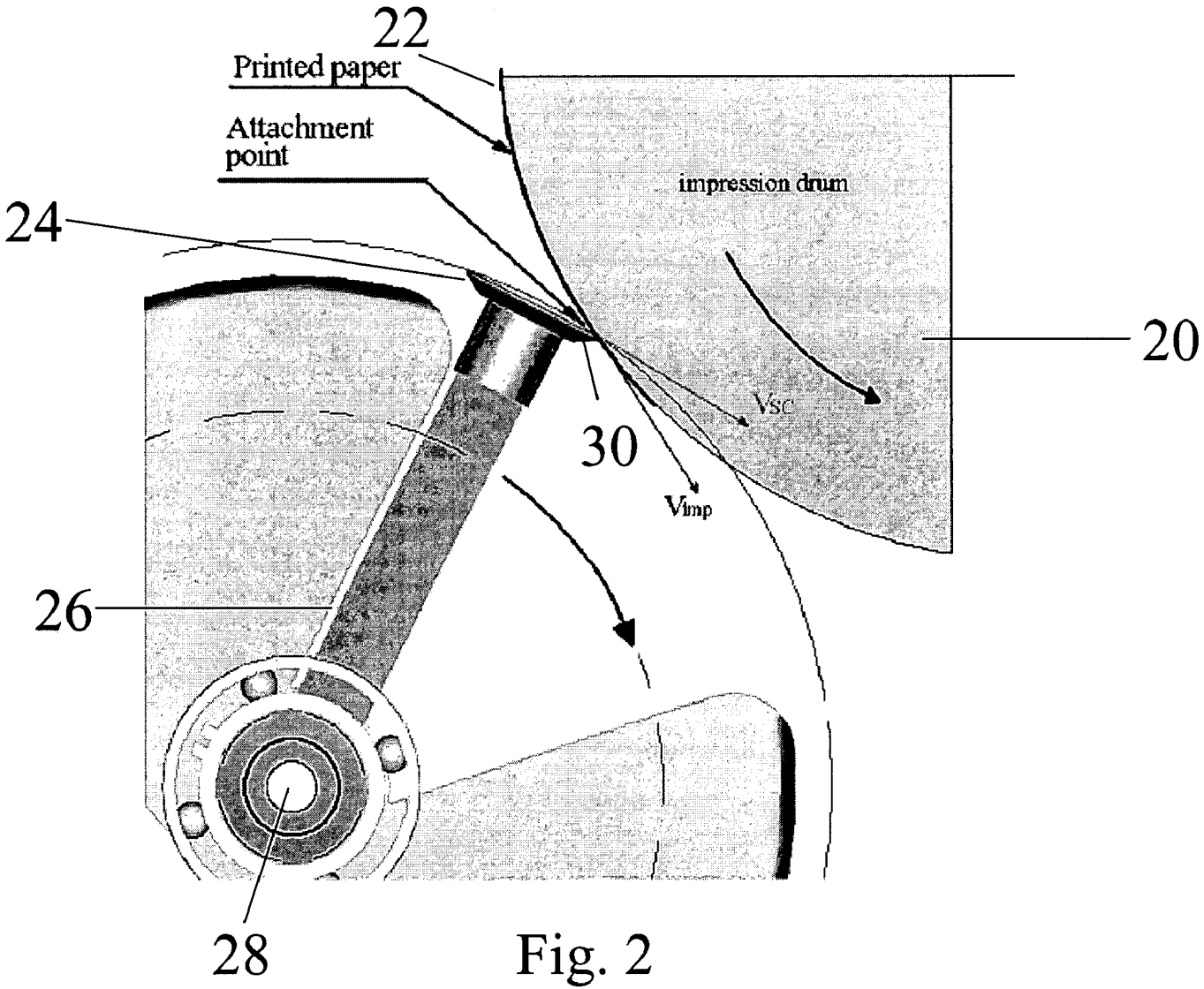
FIG. 2 is a simplified diagram showing an impression drum and paper peeling apparatus according to the prior art and showing the presumed causes of the impact damage shown in FIG. 1.

The present embodiments comprise a peeling mechanism for peeling a print medium from an impression drum in which a radial component is added to the rotary motion of a vacuum finger as it approaches the paper. The finger is slightly too short on its own to reach the impression drum without moving radially outwards. The radial motion ensures that the brim of the suction cap approaches the paper radially rather than tangentially and therefore avoids both impacts due to any overextension of the brim from the circumference of travel of the vacuum finger and damage due to any mismatch in velocities between the brim and the paper as the brim strikes the print medium.

The radial motion may be achieved by use of a non-rotating cam within the mounting of the vacuum finger. The cam has a lobe and the lobe is orientated towards the point at which the rotations of the vacuum finger and the drum meet. The vacuum finger simply rides over the cam.

The principles and operation of a paper peeling mechanism according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Figure 3:
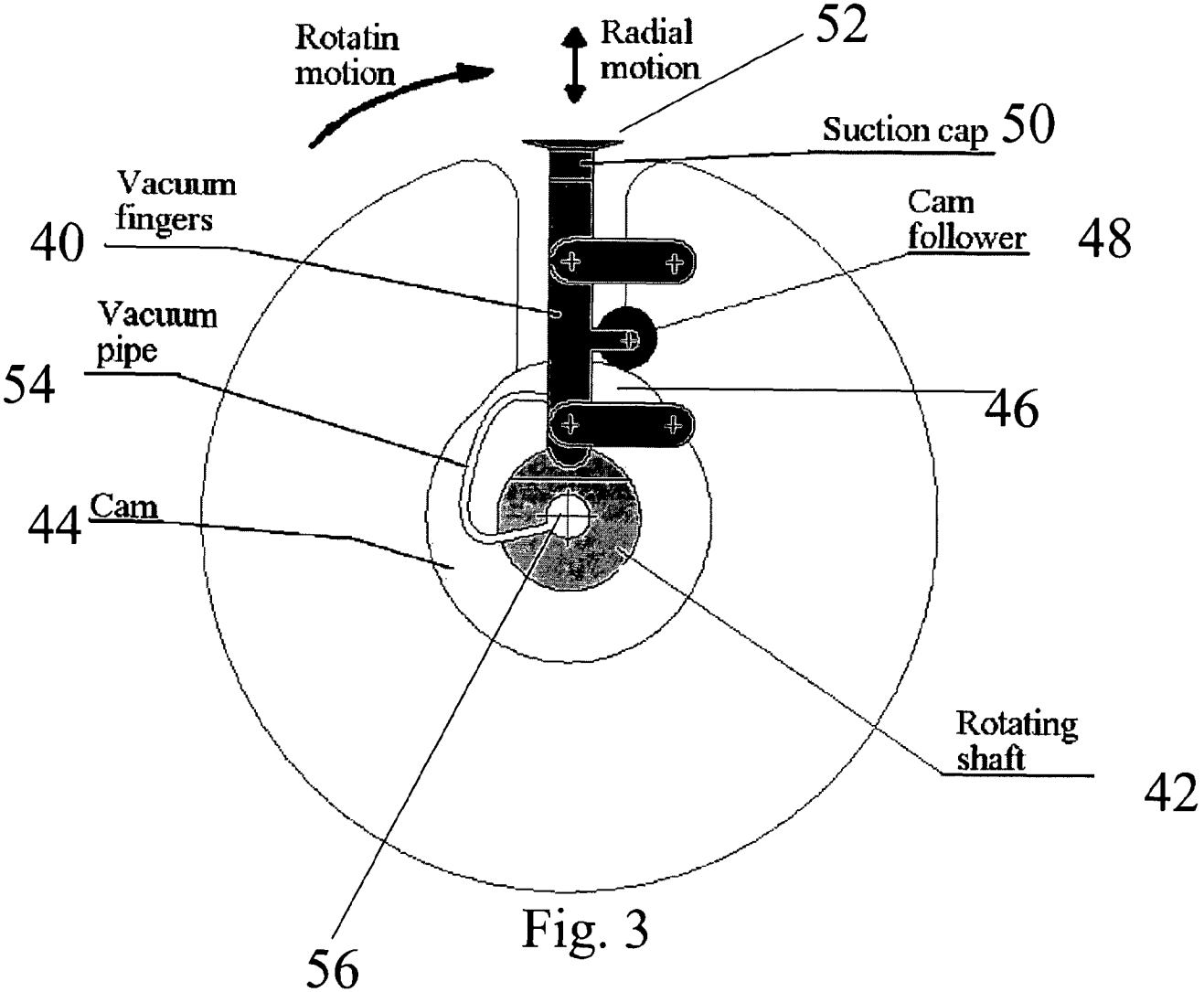
FIG. 3 is a simplified diagram showing an impression drum and paper peeling apparatus according to a first embodiment of the present invention.

Reference is now made to FIG. 3, which illustrates a peeling arrangement comprising a peeling mechanism, based on vacuum fingers, for peeling the print medium from an impression drum following transfer of the impression from the blanket. The present embodiment relates to a three drum system in which a first, electrostatic, drum transfers the image to a blanket on a middle drum. The blanket then transfers the image to the paper which is held on a third drum known as the impression drum. The present embodiments relate to the peeling of the paper from the impression drum following transfer of the images.

The arrangement comprises rotating vacuum fingers such as finger 40, for applying vacuum to the paper or like print medium to peel paper from the impression drum after printing. The vacuum finger 40 is mounted so as to move radially towards the impression drum at the point at which the paper is peeled from the drum.

Vacuum finger 40 may be mounted radially from a rotating shaft 42 in such a way that rotation of the shaft is transferred to the finger 40, and the finger rotates with the shaft. The finger is however mounted in such a manner that it has a certain freedom of motion in the radial direction so that it can be pulled outwards to describe a greater radius or inwards to describe a smaller radius about the shaft 42. A non-circular cam 44, which does not itself rotate, and which has an lobe 46, is fitted over the shaft at the point at which the finger is mounted thereon and the finger is arranged to ride over the cam with the help of cam follower 48, so that the cam now defines a radial component for the motion of the finger. The lobe 46 is aligned with the point at which the paper is to be peeled from the drum.

The finger has, at its far end from the rotating shaft 42, a suction cap 50 for applying vacuum to the paper. The suction cap has a brim 52 with an outer radius which is greater than the outer radius of the vacuum finger and would normally travel outside the circumference of the finger in regular rotational motion. However the cam is sized such as to provide a radial approach of the suction cap to the paper which is sufficient to prevent an impact of the outer or brim radius with the paper.

The rate of rotation of the end of the vacuum finger is selected to equalize the velocity of the suction cap with the paper at the point of touch. The equalization of the rotational velocity together with the application of the radial motion ensures that there is no impact damage.

As the radius of the vacuum finger changes during rotation, flexible tube 54 is provided which links the hollow interior of the vacuum finger 40 with a hollow interior 56, of the shaft 42. Thus vacuum may be supplied to the paper from the suction cap via the hollow tube within the finger, which in turn obtains the vacuum from the hollow interior 56 of the rotary shaft and ultimately from a vacuum source.

It will be appreciated that there is generally provided a number of vacuum fingers as necessary to peel the paper in the most efficient manner possible from the drum.

Figure 4:
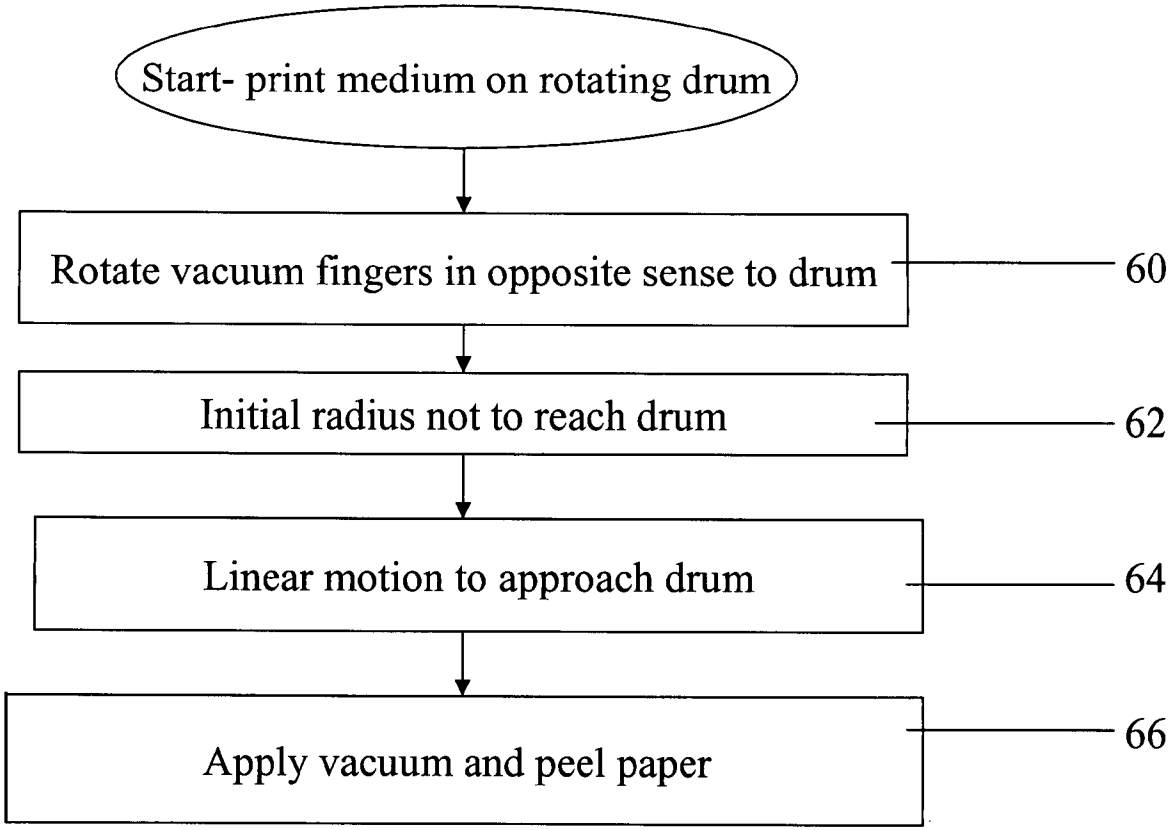
FIG. 4 is a simplified flow chart illustrating the process of peeling paper from the impression drum according to a second embodiment of the present invention.

Reference is now made to FIG. 4, which is a simplified flow chart illustrating the process of peeling paper from a print drum according to an embodiment of the present invention. The procedure begins with the paper rotating on the drum and receiving the impression. In a stage 60 the vacuum fingers are rotating about the shaft in the sense opposite to that of the drum. Whilst away from the shaft, 62, the radius is too short for the suction caps on the end of the fingers to reach the drum. However, as the fingers approach the drum at the peeling point, in stage 64, the radius is extended as the fingers ride over the lobes of their respective cams and the suction caps arrive with a radial component of motion at the paper and peel it from the drum.

As referred to above, certain impression drums perform multi-color printing in a spread by applying different impressions using different color inks at different separations, each separation involving a rotation of the drum. Thus the paper remains on the drum for all of the separations of the spread and is not peeled from the drum until all of the rotations are complete. For example in seven color printing, the paper rotates seven times but is only peeled from the drum at the seventh rotation.

In order to avoid impact damage from the suction caps during the initial six rotations, it is possible simply to disconnect the rotation of the vacuum fingers from their respective cams or more simply to detach the cams. Thus the suction heads do not in fact approach the paper at all during the initial rotations.

Figure 5:
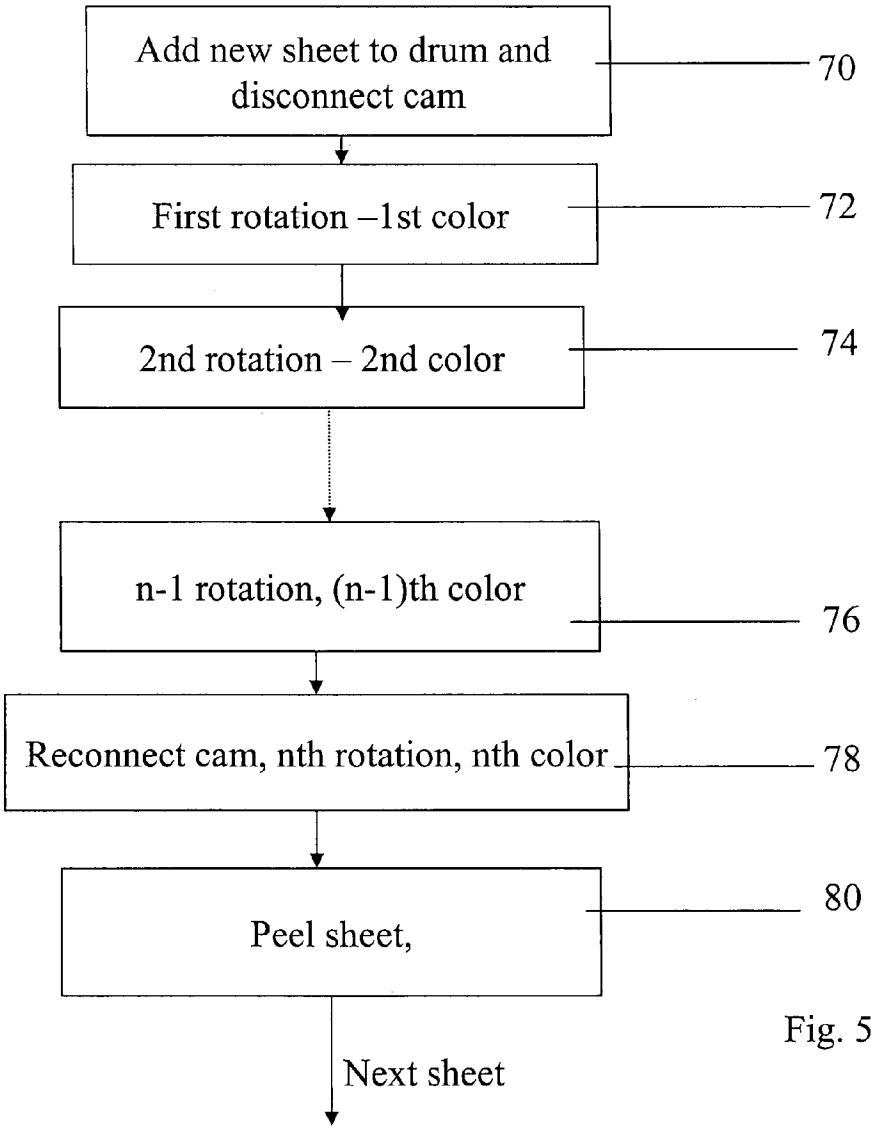
FIG. 5 is a simplified flow chart illustrating a multi-color printing spread involving multiple separations or individual separate rotations of a drum. The spread is carried out using an embodiment of the present invention in which the vacuum fingers are set to an idling motion for those rotations in which the paper is not to be peeled from the drum.

The procedure is illustrated in the simplified flow chart of FIG. 5, to which reference is now made. FIG. 5 shows an n-color printing process or spread. Firstly in a stage 70 the paper is loaded onto the drum and the cam is disconnected. A first impression using a first color ink is applied in stage 72. In additional separations up to n-1, further rotations of the drum involve applications of further impressions using further colored inks, stages 74 and 76. Then in stage 78 the cams are reconnected and the nth color impression is applied. In stage 80 the paper is peeled from the drum.

With the prior art, the n-color printing spread shown in FIG. 5 would have led to n impacts per suction head on each sheet of printing medium. By contrast, in the illustrated embodiment, no contact occurs during the first n-1 rotations between the suction heads and the printing sheets, and at the nth rotation, only the gentlest of impact free linear approaches occurs.

It is expected that during the life of this patent many relevant printing systems, paper feed mechanisms and paper peeling mechanisms and systems will be developed and the scope of the corresponding terms herein are intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A printing and peeling arrangement comprising:

an impression drum for supporting a print medium for receipt of a printing image, a rotating shaft, and at least one rotating vacuum finger extending from said shaft along a radial axis of said shaft for applying vacuum to said print medium to remove said print medium from said impression drum after receipt of said printing image, wherein a radial component of motion along said radial axis towards said impression drum is applied to said vacuum finger.

2. The printing arrangement of claim 1, wherein said at least one vacuum finger is mounted on said rotating shaft via a cam, and wherein said cam applies said radial component of motion to said at least one vacuum finger.

3. The printing arrangement of claim 2, wherein said cam is configured via a lobe orientated towards said drum.

4. The printing arrangement of claim 3, wherein said at least one vacuum finger has a radius of rotation which is insufficient to reach said drum when not riding on said lobe but which is sufficient to reach said drum when riding on said lobe.

5. The printing arrangement of claim 2, wherein an idling motion of said at least one vacuum finger is provided in which said radial component of motion is not applied to said at least one vacuum finger.

6. The printing arrangement of claim 2, wherein said at least one vacuum finger comprises a suction head for applying said vacuum to said print medium, said suction head having an outer radius greater than an outer radius of said at least one vacuum finger, and said radial component of motion is sufficient to prevent an impact of said outer radius of said suction head with said print medium.

7. The printing arrangement of claim 6, wherein a rate of rotation of said at least one vacuum finger is such as to equalize a velocity of said suction head with said print medium at a point of touch.

8. The printing arrangement of claim 7, wherein said impression drum has a rotation in a first sense when printing and said at least one vacuum finger has a rotation in an opposite sense, thereby to achieve said equalized velocity.

9. The printing arrangement of claim 1, wherein said at least one vacuum finger is connected via a flexible vacuum tube to a vacuum source.

10. The printing arrangement of claim 1, wherein the printing arrangement is part of a multi-color printing arrangement which applies impressions in a spread involving different colors at successive separations.

11. Peeling apparatus for peeling a print medium from an impression drum after application of an impression to said print medium, the apparatus comprising a vacuum finger and mounting therefor, the mounting comprising a shaft and a cam, the vacuum finger being mounted radially about said shaft along a radial axis of said shaft thereby to rotate about said shaft and further being mounted on said cam, said cam being configured with a lobe to transfer a radial motion component along said radial axis to said vacuum finger upon said rotation, the lobe being aligned such that said radial motion component provides a linear approach to said impression drum.

12. Apparatus according to claim 11, wherein an idling motion of said vacuum finger is provided in which said radial motion component is not transferred to said vacuum finger.

13. Apparatus according to claim 11, wherein said vacuum finger comprises a suction head for applying a vacuum to said print medium, said suction head having an outer radius greater than an outer radius of said vacuum finger, and said radial motion component is sufficient to prevent an impact of said outer radius of said suction head with said print medium.

14. Apparatus according to claim 13, wherein a rate of rotation of said vacuum finger is such as to equalize a velocity of said suction head with said print medium at a point of touch.

15. Apparatus according to claim 14, wherein said impression drum has a rotation in a first sense when printing and said vacuum finger has a rotation in an opposite sense, thereby to achieve said equalized velocity.

16. Apparatus according to claim 11, wherein is connected via a flexible vacuum tube to a vacuum source.

17. Apparatus according to claim 11, wherein said apparatus is part of a multi-color printing system which applies impressions in different colors at successive rotations of said impression drum.

18. A method for peeling a print medium from a rotating drum, the drum rotating in a first sense, the method comprising:

mounting at least one vacuum finger in proximity to said drum along a radial axis of a shaft, applying vacuum via said at least one vacuum finger to said print medium, rotating said at least one vacuum finger with a rotary motion in a second opposite sense, and applying a linear component to said rotary motion such as to cause said at least one vacuum finger to extend linearly outwards along said radial axis of said shaft upon approaching said drum to contact said print medium and retract linearly along said radial axis of said shaft upon receding from said drum.

19. The method of claim 18, further comprising providing an idling motion in which said linear component is not applied to said rotary motion of said at least one vacuum finger and said print medium is not contacted.

20. The method of claim 18, comprising:

providing an idling motion of said at least one vacuum finger in which said print medium is not contacted, carrying out a predetermined number of rotations of said drum, providing said linear component for a final rotation of said drum, and peeling said print medium from said drum at said final rotation.

21. The method of claim 20, comprising applying an impression using a different color ink for each rotation of said drum.

22. A method for peeling a print medium from a rotating drum, the drum rotating in a first sense, the method comprising:

mounting at least one vacuum finger having a suction cap in proximity to said rotating drum along a radial axis of a shaft, applying vacuum via said at least one vacuum finger to said suction cap, rotating said at least one vacuum finger with a rotary motion in a second opposite sense, and applying a linear component to said rotary motion such as to cause said at least one vacuum finger to extend linearly outwards along said radial axis of said shaft upon approaching said drum to contact said print medium and retract linearly along said radial axis of said shaft upon receding from said drum.

* * * * *

UNITED STATES PATENT AND TRADEMARK OFFICE

CERTIFICATE OF CORRECTION

PATENT NO. : 8,302,955 B2
APPLICATION NO. : 11/155933
DATED : November 6, 2012
INVENTOR(S) : Aron Shmaiser et al.

It is certified that error appears in the above-identified patent and that said Letters Patent is hereby corrected as shown below:

In column 8, line 38, in Claim 16, after "wherein" insert -- said vacuum finger --.

Signed and Sealed this
Nineteenth Day of February, 2013

Teresa Stanek Rea
*Acting Director of the United States Patent and Trademark Office*